US011691425B2

(12) United States Patent
Ookubo et al.

(10) Patent No.: US 11,691,425 B2
(45) Date of Patent: Jul. 4, 2023

(54) INKJET RECORDING APPARATUS

(71) Applicant: CANON FINETECH NISCA INC., Saitama (JP)

(72) Inventors: Yukito Ookubo, Tsukuba (JP); Masaki Oota, Matsudo (JP); Noritaka Oota, Kashiwa (JP)

(73) Assignee: Canon Finetech Nisca Inc., Saitama (JP)

( * ) Notice: Subject to any disclaimer, the term of this patent is extended or adjusted under 35 U.S.C. 154(b) by 86 days.

(21) Appl. No.: 17/179,076

(22) Filed: Feb. 18, 2021

(65) Prior Publication Data

US 2021/0260878 A1 Aug. 26, 2021

(30) Foreign Application Priority Data

Feb. 26, 2020 (JP) ..... 2020-030989

(51) Int. Cl.
*B41J 2/165* (2006.01)

(52) U.S. Cl.
CPC ..... *B41J 2/16538* (2013.01); *B41J 2/16505* (2013.01); *B41J 2/16532* (2013.01); *B41J 2/16544* (2013.01); *B41J 2002/16573* (2013.01); *B41J 2002/16594* (2013.01); *B41P 2235/20* (2013.01); *B41P 2235/27* (2013.01)

(58) Field of Classification Search
CPC ..... B41J 2/16538; B41J 2/16505; B41J 2/16532; B41J 2/16544; B41J 2002/16573; B41J 2002/16594; B41J 2/16517
See application file for complete search history.

(56) References Cited

U.S. PATENT DOCUMENTS

| | | | | |
|---|---|---|---|---|
| 6,273,547 | B1 | 8/2001 | Aldrich | 347/36 |
| 7,513,592 | B2 | 4/2009 | Miyazawa | 347/29 |
| 8,746,841 | B2 * | 6/2014 | Ikeda | B41J 2/16538 347/33 |

FOREIGN PATENT DOCUMENTS

| | | |
|---|---|---|
| JP | H11-198413 | 7/1999 |
| JP | 2000-238295 | 9/2000 |
| JP | 2005-349782 | 12/2005 |

(Continued)

OTHER PUBLICATIONS

Office Action dated Feb. 1, 2022 in counterpart Japanese Application No. 2020-030989, together with English translation thereof.

*Primary Examiner* — Geoffrey S Mruk
(74) *Attorney, Agent, or Firm* — Venable LLP

(57) ABSTRACT

Provided is an inkjet recording apparatus that performs inkjet recording on a recording medium in a recording region. The inkjet recording apparatus includes a recording head that includes an ejection port surface where an ejection port for ejecting ink is provided, is the recording head being movable within a range including the recording region and a non-recording region where the recording is not performed, a cap capable of letting the ejection port in a capping state in the non-recording region, a blade that is placed between the recording region and the cap in a moving direction of the recording head, the blade being capable of wiping the ejection port of the recording head as the recording head moves from the non-recording region to the recording region, a blade moving unit capable of moving the blade up and down, and a control unit that controls the blade moving unit.

8 Claims, 15 Drawing Sheets

(56) References Cited

FOREIGN PATENT DOCUMENTS

| | | |
|---|---|---|
| JP | 2007-083706 | 4/2007 |
| JP | 2007-090715 | 4/2007 |
| JP | 2008-307797 | 12/2008 |
| JP | 2011-110840 | 6/2011 |
| JP | 2016-210051 | 12/2016 |

* cited by examiner

INKJET RECORDING APPARATUS

BACKGROUND OF THE INVENTION

Field of the Invention

The present invention relates to an inkjet recording apparatus.

Description of the Related Art

Currently, inkjet recording apparatuses are widely used to perform inkjet recording by ejecting ink from ink ejection ports of a recording head to a recording medium. In such an inkjet recording apparatus, foreign matters may adhere to an ejection port surface where the ejection ports are provided or where ink inside an ejection port dries, thickens, and clogs the ejecting port. In such cases, the ejection port in question is incapable of normal ejection, which may lead to faulty image recording.

To address this, there have been conventionally known inkjet recording apparatuses provided with a cleaning means to remove the foreign matters and thickened ink. This cleaning means has a different form or uses a different method depending on the apparatus. As a representative example, there is a means called preparatory ejection that ejects ink to a cap beforehand to discharge foreign matters or thickened ink so that ink may be normally ejected to a recording medium.

To perform the preparatory ejection, foreign matters or thickened ink inside the ejection ports is ejected, and the cap is provided to receive them. Mainly, the cap is provided with a porous ink absorber inside. This ink absorber plays a role as a receiver for the preparatory ejection performed to discharge the ink inside the ejection ports. In addition, another form exists using a suction pump capable of generating pressure to suck in the ink accumulated in the cap and a tube-shaped flow channel portion that connects the cap and the suction pump to each other.

The preparatory ejection operation described above changes the amount of ink to be discharged by the preparatory ejection according to the state of the foreign matters adhered to the ejection port surface or thickened ink. In a case where the adhered foreign matters or thickened ink is stubborn, they are typically removed using powerful cleaning.

However, depending on the amount of ink ejected and discharged to the cap in the cleaning described above, air inherently present in the ink absorber may be pushed out to the surface of the ink absorber, which generates ink bubbles. Preparatory ejection performed with ink and air coexisting inside the ink absorber may also cause the ink inside the absorber to be pushed out to the surface of the ink absorber along with the air, which generates ink bubbles. Then, the bubbles may break during the preparatory ejection and scatter around the cap.

To address this ink scattering phenomenon during cleaning, Japanese Patent Laid-Open No. 2011-110840, for example, discloses preventing the scattering of ink by providing an apparatus with a dedicated shield means for shielding the region where the preparatory ejection is performed from the other region. There are other means, such as providing a fan inside the recording apparatus to absorb a mist of ink generated during the cleaning operation and collect the mist of ink into a collecting reservoir placed inside the apparatus, as a waste liquid.

Japanese Patent Laid-Open No. 2011-110840, however, discloses problems such as increasing the size of the unit or the costs because of the dedicated shield means or suction fan provided in the apparatus to prevent the scattering of ink.

SUMMARY OF THE INVENTION

The present invention has an object to provide an inkjet recording apparatus capable of helping prevent scattering of ink to the recording region that may occur during an preparatory ejection operation, without providing a dedicated shield means.

An example of the means to solve the problems to be solved by the present invention is an inkjet recording apparatus that performs inkjet recording on a recording medium in a recording region, including: a recording head that includes an ejection port surface where an ejection port for ejecting ink is provided, the recording head being movable within a range including the recording region and a non-recording region where the recording is not performed; a cap capable of setting the ejection port in a capping state in the non-recording region; a blade that is placed between the recording region and the cap in a moving direction of the recording head, is the blade being capable of wiping the ejection port of the recording head in a case where the recording head moves from the non-recording region to the recording region; a blade moving unit capable of moving the blade up and down, the blade moving unit being capable of moving the blade to a first position where an upper edge of the blade is at a higher level than the ejection port surface and to a second position where the upper edge of the blade is at a lower level than the ejection port surface; and a control unit that controls the blade moving unit so that the blade is placed at the second position in an event where the ejection port surface and the blade are at positions overlapping with each other in the moving direction of the recording head in a case where the recording head is moving from the recording region to the non-recording region, and the blade is placed at the first position in an event where preparatory ejection is being performed, the preparatory ejection being to eject ink from the ejection port to the cap that is not in the capping state.

Further features of the present invention will become apparent from the following description of exemplary embodiments with reference to the attached drawings.

DESCRIPTION OF THE EMBODIMENTS

A preferred embodiment of the present invention is described with reference to the drawings. Note that components described in the following embodiment are given merely as examples and are not intended to limit the scope of the present invention only to them.

Figure 1:
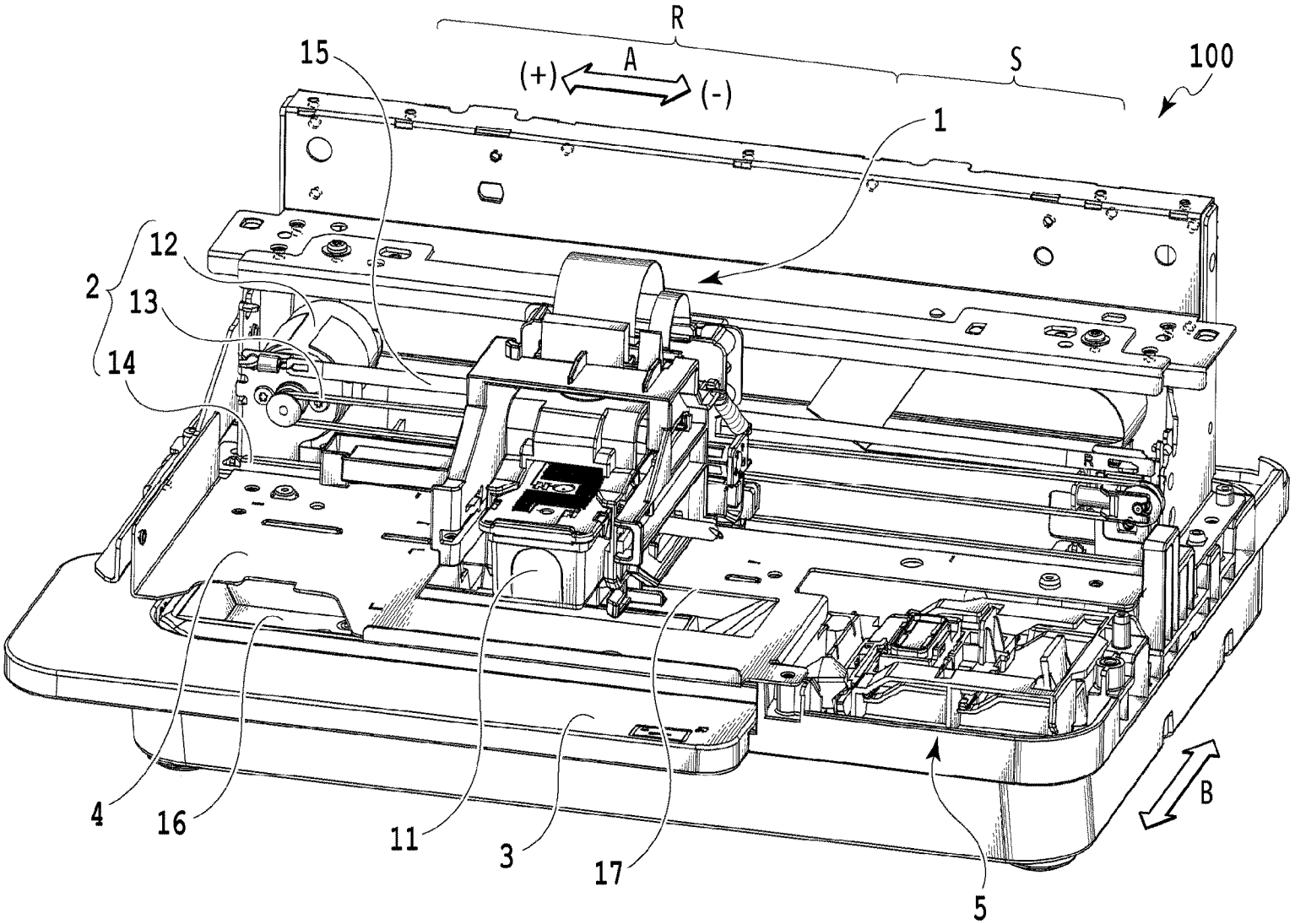
FIG. 1 is a perspective view showing an embodiment of an inkjet recording apparatus according to the present invention.

FIG. 1 is a perspective view showing one embodiment of an inkjet recording apparatus according to the present invention.

An inkjet recording apparatus 100 (exterior components are not shown) includes a carriage unit 1, a carriage driver unit 2, a recording medium setting mechanism 3, a recording surface reference member 4, and a cleaning unit 5. These parts are supported by the base member of the inkjet recording apparatus 100 either directly or indirectly. The following describes each of the units of the inkjet recording apparatus 100 shown in FIG. 1.

Carriage Unit and Carriage Driver Unit

The carriage unit 1 is capable of supporting a recording head 11 for performing inkjet recording on a recording medium. The recording head 11 is formed integrally as a cartridge including an ejection portion and an ink tank. The recording head 11 is provided with an array of recording elements that eject ink using an inkjet method.

Each recording element of the present embodiment is formed by an ejection port 11*a* (see FIG. 7 and other drawings) from which ink that is supplied from the ink tank is ejected and an ejection energy generating element (not shown) provided inside the ejection port 11*a*. As the ejection energy generating element, an electrothermal conversion element (heater), an electromechanical conversion element (a piezoelectric element), or the like is used. An array of the recording elements extend in a sub scanning direction (the direction of arrow B) intersecting with a main scanning direction (the direction of arrow A) which is a moving direction of the carriage unit 1.

The carriage driver unit 2 includes a carriage driving motor 12 which is a drive source, a driving belt 13 that conveys the driving force from the carriage driving motor 12 to the carriage unit 1, and a guide portion 14. With an engagement portion (not shown) of the carriage unit 1 engaging with the driving belt 13, the carriage unit 1 and the driving belt 13 can move together in the main scanning direction (the A direction).

In the present embodiment, a DC motor is used as the carriage driving motor 12, but any other means, such as a stepping motor, may be used instead as long as it can convey a driving force to the driving belt 13. The guide portion 14 is fixed to the base member of the inkjet recording apparatus 100. The guide portion 14 guides the carriage unit 1 so that the carriage unit 1 may move correctly in the main scanning direction, and also restricts the position of the recording head 11 on the carriage unit 1 in terms of the sub scanning direction (the direction of arrow B).

The carriage unit 1 slidably engages with the guide portion 14 to maintain the posture of the carriage unit 1. A linear encoder 15 is provided above the region where the carriage unit 1 operates. The linear encoder 15 controls the ejection timing of the recording head 11 by detecting the position of the carriage unit 1 that operates in the main scanning direction using a linear encoder reading means (not shown) provided on its carriage unit 1 side. As such a position detection means, the linear encoder 15 can be replaced with a technique with a position detection capability, such as a rotary encoder, a stepping motor, or a transmission sensor.

Figure 2:
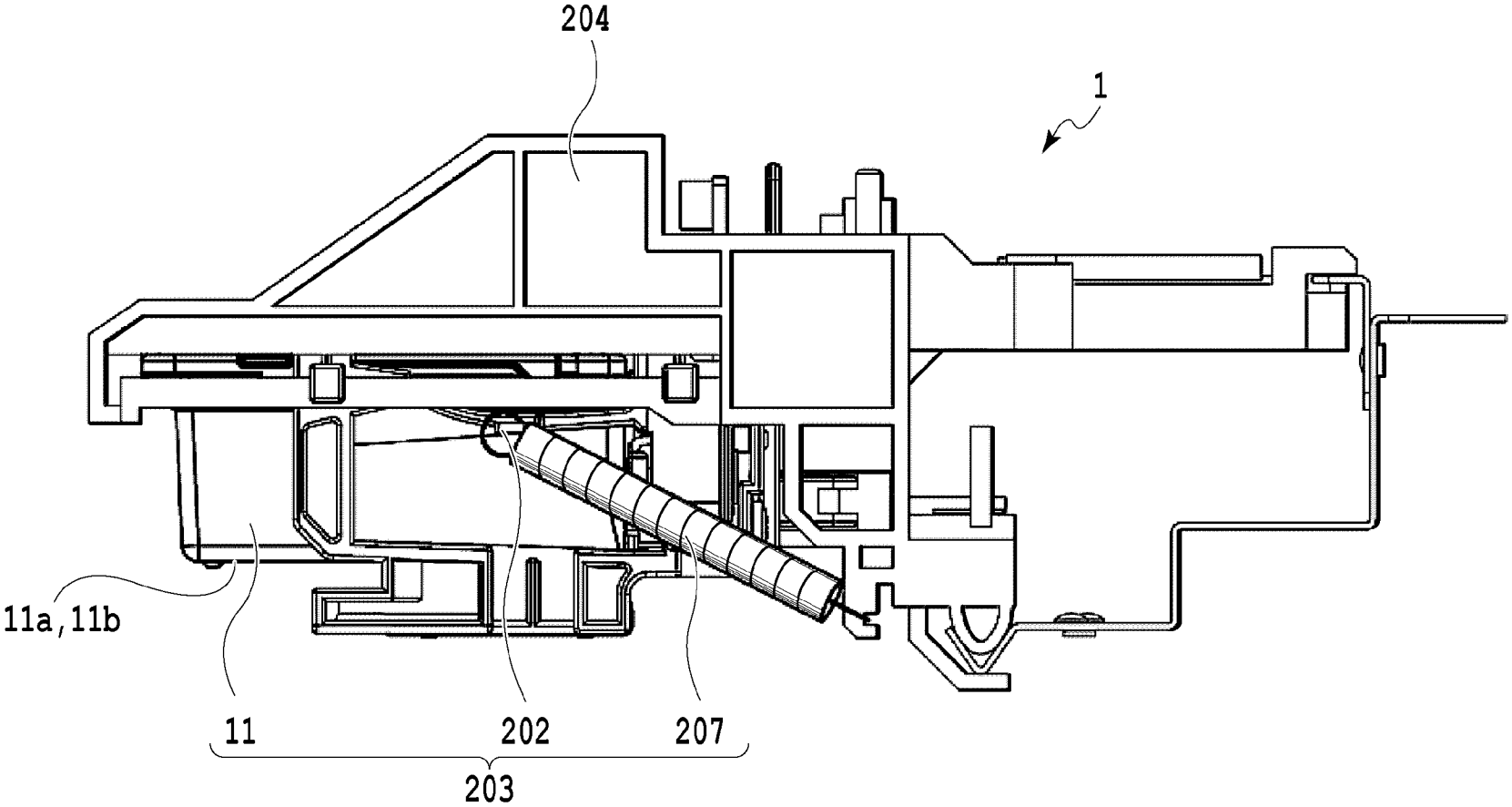
FIG. 2 is a side view of a carriage unit.

FIG. 2 is a side view of the carriage unit in FIG. 1.

The recording head 11 is formed integrally as a recording cartridge including an ejection mechanism and an ink tank. The recording head 11 includes the ejection ports 11*a* for ejecting ink, and is movable within a range including a recording region R and a non-recording region S where no recording is performed.

Note that the "recording region" in the present embodiment refers to a region where the recording head performs recording on a recording medium, and is typically a region where the recording head is movable during the recording. More specifically, the recording region is a region where the ejection portion is located in the moving direction of the recording head while the recording head is performing recording on a recording medium. The "non-recording region" refers to a region where the ejection portion is located in the moving direction of the recording head while the recording head is not performing recording, and is typically a region where the recording head is located for capping, wiping, preparatory ejection, or the like of the ejection ports.

The recording head 11 is held by a recording head holder 202, and the recording head 11 and the recording head holder 202 together form a recording system carriage 203. The recording system carriage 203 is held by a driving system carriage 204. A recording system carriage biasing member 207 causes the driving system carriage 204 and the recording system carriage 203 to engage with each other.

The recording head holder 202 includes a recording cartridge control board (not shown) that has a contact with a conductive portion of the recording cartridge. The recording cartridge control board communicates with a control unit through the conductive portion to send information such as the attachment status of the recording cartridge to the control unit. The inkjet recording apparatus 100 is provided with the linear encoder 15 to guide the driving system carriage 204 along an operation path while the driving system carriage 204 is operated back and forth in the main scanning direction. The linear encoder 15 holds the posture of the recording system carriage 203 by engaging with a predetermined portion of the driving system carriage 204.

Recording Medium Setting Mechanism and Recording Surface Reference Member

The recording medium setting mechanism 3 includes a recording medium placing unit 16 and a recording medium detection means (not shown) which is a transmission sensor. The recording medium placing unit 16 is configured such that once the recording medium detection means detects insertion of a recording medium, the recording medium placing unit 16 elevates and moves toward the recording surface reference member 4, pushing and holding the recording medium against the recording surface reference member 4.

Since the recording medium is pushed and held against the recording surface reference member 4, it can keep a certain distance from the recording head 11 regardless of the various thickness of the recording medium, such as an envelope with a content inside. The recording surface reference member 4 is provided with a cutout portion 17 so as not to prevent ink ejected from the ejection portion of the recording head 11 from landing on a recording medium.

The feeding of the recording medium is manually done by a user in the present embodiment, but may be automatically done using an automatic feeding device. Although a transmission sensor is used as the recording medium detection means (not shown) in the present embodiment, any other means, such as a contact sensor, may be employed as long as it can detect whether a recording medium is located at a specified position.

Electrical System

Next, the electrical system of the inkjet recording apparatus 100 is described with reference to FIG. 3.

Figure 3:
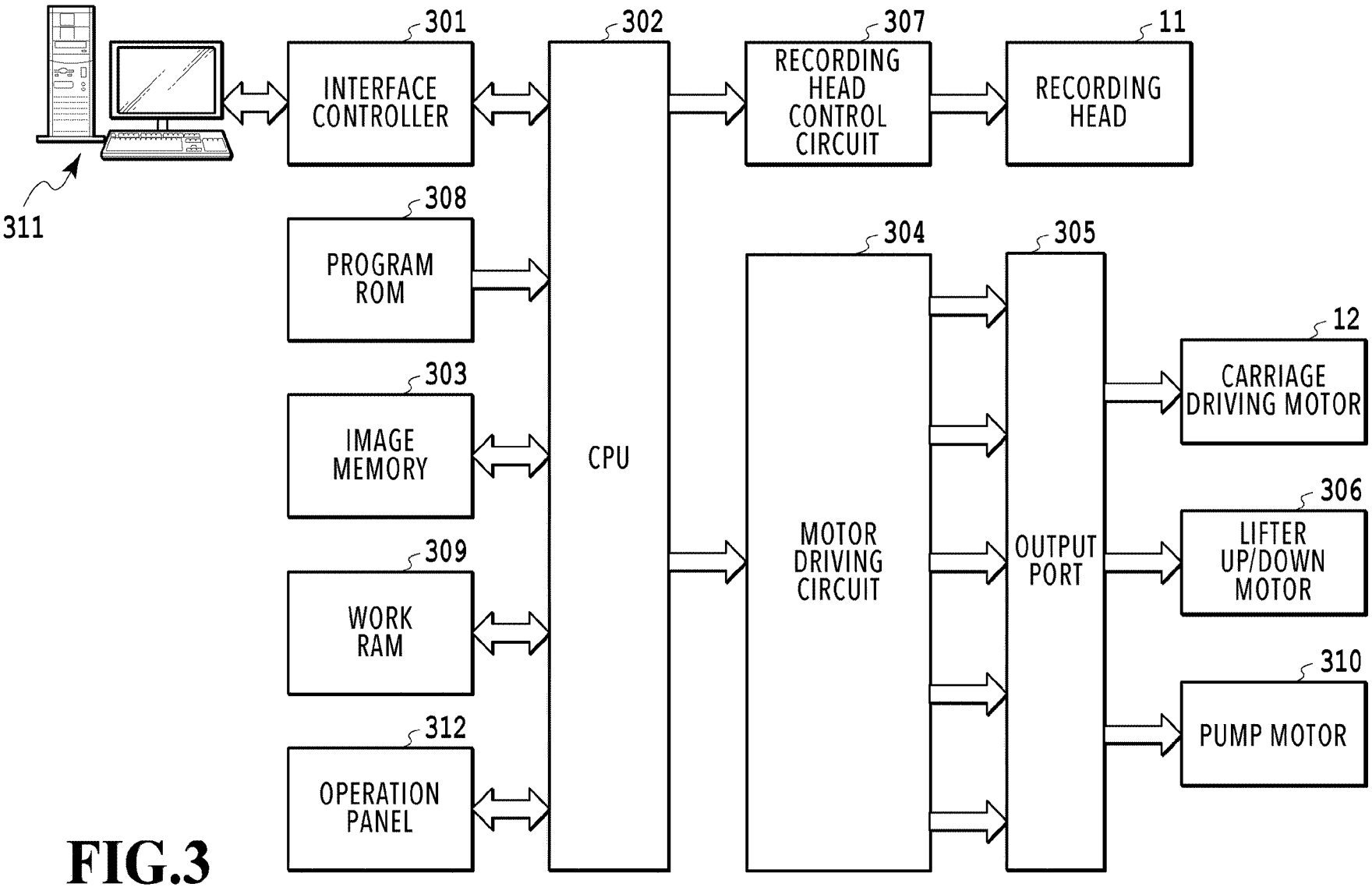
FIG. 3 is a block diagram showing the electrical system of the inkjet recording apparatus.

FIG. 3 is a block diagram showing the electrical system of the inkjet recording apparatus in FIG. 1. Recording data and commands transmitted from a host PC 311 are received by a CPU 302 via an interface controller 301.

The CPU 302 is an arithmetic processing unit that performs overall control of, e.g. receiving recording data for the inkjet recording apparatus 100, recording operations, and operations of the cleaning unit 5. The CPU 302 analyses a received command, then rasterizes image data in recording data to produce bitmap data, and stores the bitmap data in an image memory 303.

As pre-recording operation processing, a sensor (not shown) detects that a recording medium is set in the recording medium placing unit 16. After the detection by the sensor, the CPU 302 drives a lifter up/down motor 306 via a motor driving circuit 304 and an output port 305 to lift up the recording medium placing unit 16 so that a recording medium is sandwiched and fixed between the recording medium placing unit 16 and a platen member. Next, the carriage driving motor 12 is driven to move the carriage unit 1 in the main scanning direction, and the CPU 302 reads recording data from the image memory 303 and transfers the data to the recording head 11 through (via) a recording head control circuit 307.

The CPU 302 operates based on the processing programs written in a program ROM 308. The program ROM 308 stores processing programs, tables, and the like for control sequences. The CPU 302 also uses a work RAM 309 as work memory. To clean the recording head 11, the CPU 302 drives a pump motor 310 via the motor driving circuit 304 and the output port 305 to perform an ink suction operation. As will be described later, the CPU 302 serves as a control unit and controls a blade 26 so that the blade 26 moves between a wipe position T where wiping can be performed and a retreat position U where wiping is not performed. As a control unit, the CPU 302 also controls preparatory ejection that ejects ink from the ejection ports 11*a* to a cap 21.

Cleaning Unit

Figure 4:
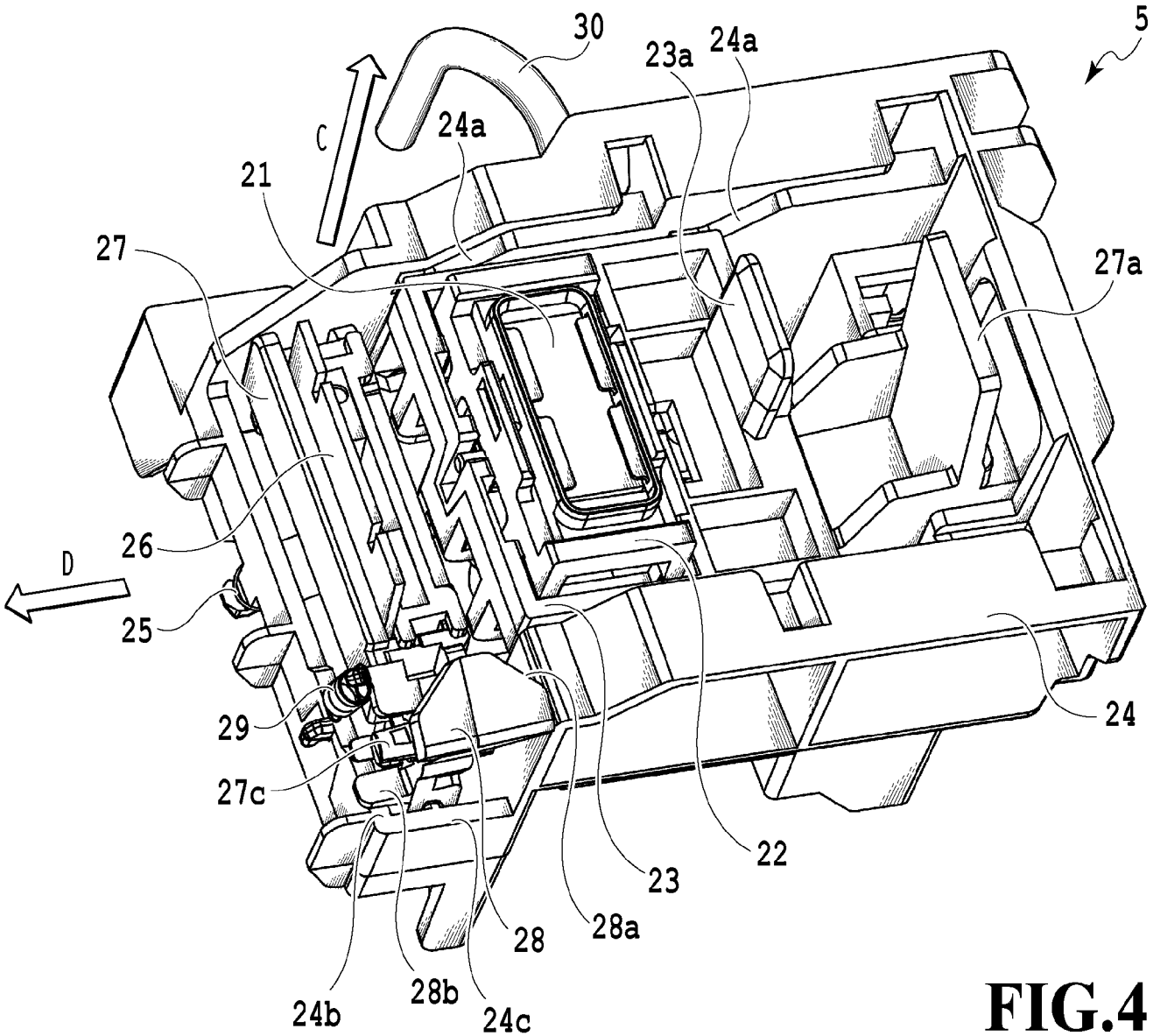
FIG. 4 is a perspective view of a cleaning unit.
Figure 5:
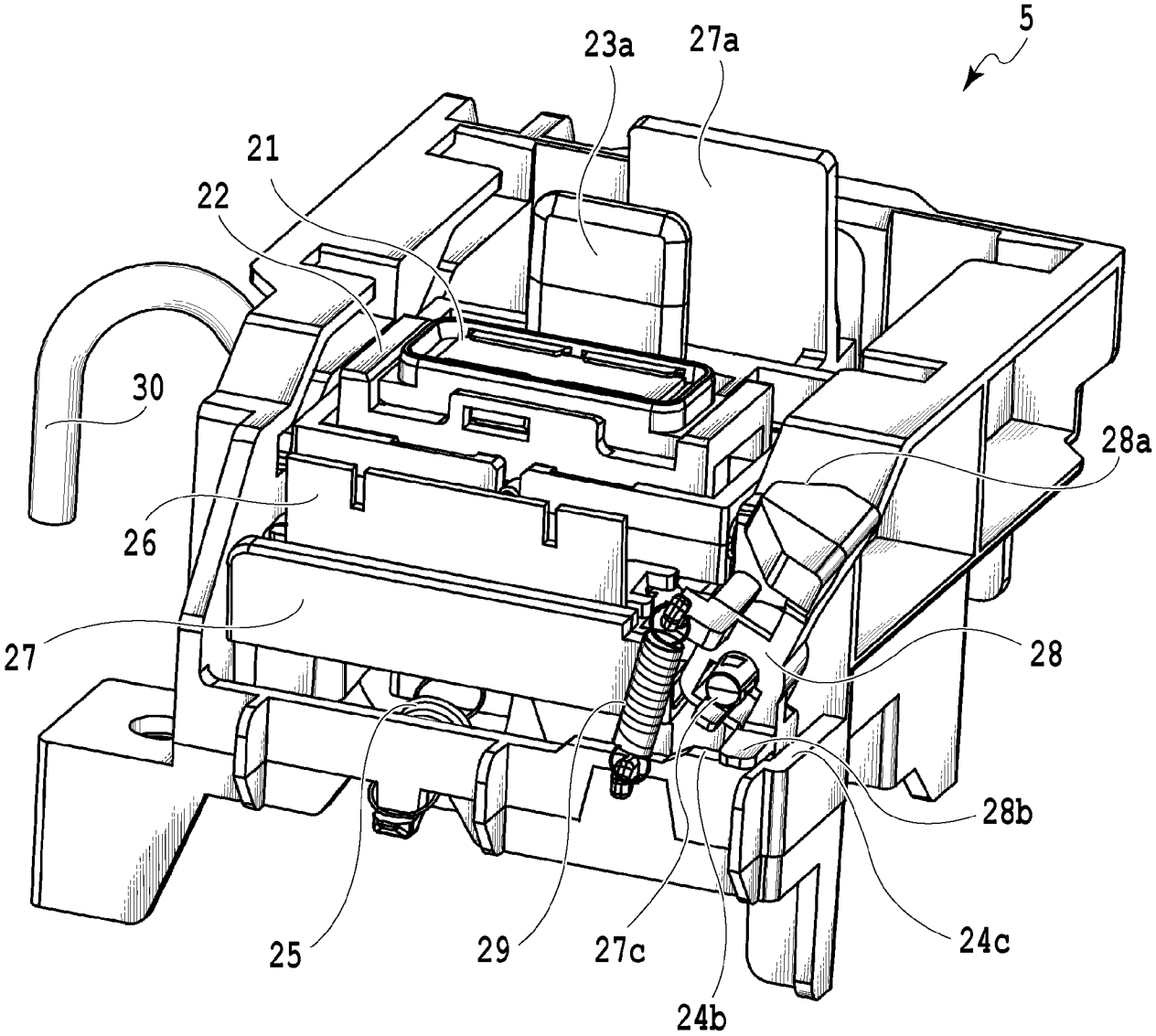
FIG. 5 is a perspective view of the cleaning unit showing a state where a blade is located at a wipe position.
Figure 6:
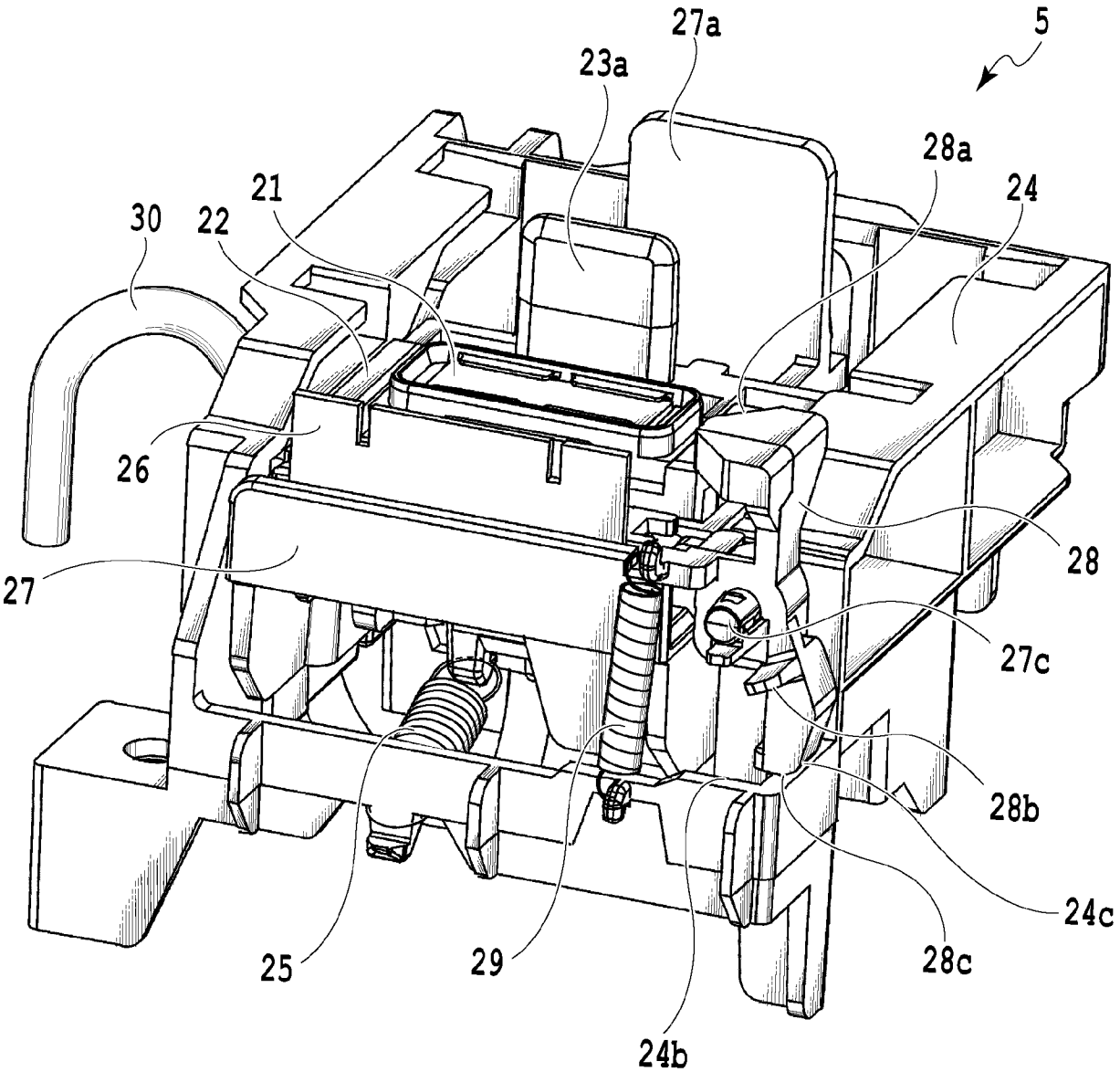
FIG. 6 is a perspective view of the cleaning unit showing a state where the blade is at a retreat position.

The inkjet recording apparatus 100 of the present embodiment includes the cleaning unit 5 (FIG. 1) that performs cleaning operations for maintaining and recovering the ejection performance for ejecting ink droplets from the ejection ports 11*a*. FIGS. 4, 5, and 6 are perspective views of the cleaning unit in FIG. 1. The cleaning unit 5 includes the cap 21, the blade 26, and a suction pump 34 (see FIGS. 11 and 12).

As will be described later, the cleaning unit is capable of performing preparatory ejection, wiping, nozzle suction, and emptying suction. The CPU 302 performs a cleaning operation using the cleaning unit 5, the cleaning operation being a combination of preparatory ejection, wiping, nozzle suction, and emptying suction performed in a series.

The cap 21 is for keeping the moisture in and protecting the ejection ports 11*a* of the ejection portion of the recording head 11. The cap 21 is held by a cap holder 22 with a lug (not shown) provided to the cap holder 22 engaging with a cap base 23. The cap 21 is biased in the direction of arrow C (vertically upward (the direction toward the recording head 11)) by a spring (not shown) capable of swinging relative to the cap base 23.

The cap base 23 is provided with four arms 23*b* (see FIGS. 7 to 10). Each arm 23*b* is suspended in such a manner as to be movable along a groove 24*a* provided to a cleaning unit base 24, and is biased in the direction of arrow D by a spring 25. In the non-recording region S, the upper surface of the cap 21 comes into contact with the recording head 11 and covers the ejection ports 11*a* to bring the cap 21 into a capping state.

To perform preparatory ejection (details will be given later) to discharge ink inside the ejection ports 11*a* of the recording head 11, ink is ejected onto the cap 21. The suction pump 34 can apply a negative pressure to the inside of the cap 21. By applying a negative pressure to the inside of the cap 21 in the capping state, the suction pump 34 can perform nozzle suction to suck ink from the ejection ports 11*a*.

By applying a negative pressure to the inside of the cap 21 with the cap 21 not capping the ejection ports 11*a*, the suction pump 34 can perform cap emptying suction to suck ink accumulating in the cap 21. Ink accumulating in the cap 21 sucked by the suction pump 34 is discharged into a waste liquid tank 35 (see FIGS. 11 and 12).

The cap base 23 includes an integrally-molded first lever 23*a* for elevating the cap 21. The cap 21 is configured such that once the carriage unit 1 pushes the first lever 23*a* in an A (−) direction (a second direction), the cap 21 elevates and caps the ejection ports 11*a*.

Figure 7:
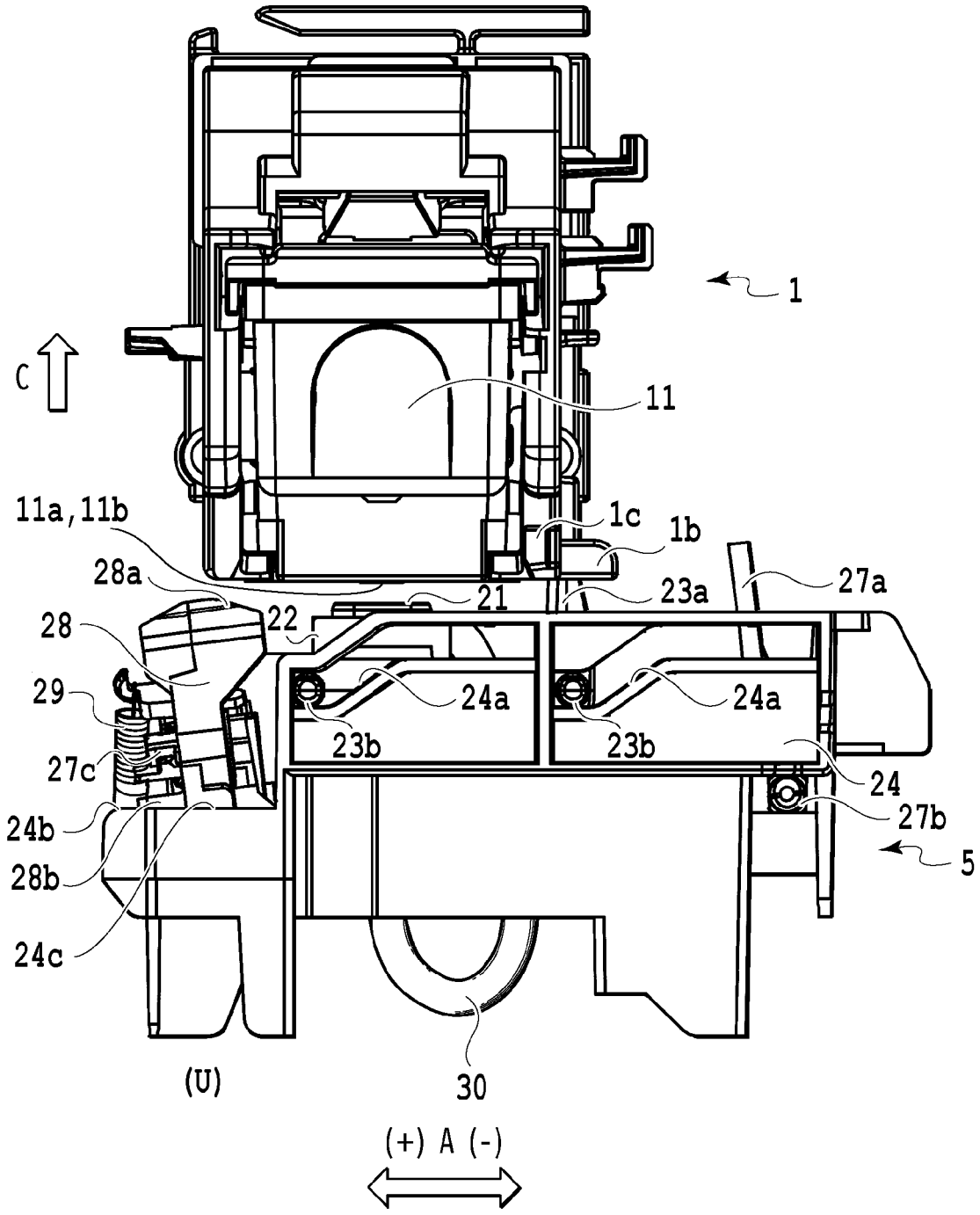
FIG. 7 is a side view showing a state where the blade is located at the retreat position.

A blade base 27 has a second lever 27*a* and a blade base shaft portion 27*b* (see FIG. 7). The second lever 27*a* and the blade base shaft portion 27*b* are integrally molded with the blade base 27. The second lever 27*a* causes the blade 26 to turn with the blade base shaft portion 27*b* serving as a pivot. The blade base 27 is pivotally supported in such a manner as to be able to turn relative to the cleaning unit base 24 with the blade base shaft portion 27*b* serving as a pivot.

The blade base 27 supports the blade (also called a wiper) 26. The blade 26 wipes and cleans an ejection port surface 11*b* (see FIG. 7 and other drawings) where the ejection ports 11*a* are formed. The blade 26 is configured such that, in an event where the carriage unit 1 further pushes the second lever 27*a* in the A (−) direction (the second direction) after pushing the first lever 23*a*, the blade 26 turns and elevates to a position where the blade 26 can performing wiping. In the non-recording region S, the blade 26 can wipe the ejection ports 11*a*.

The cleaning unit 5 has the cleaning unit base 24. The cleaning unit base 24 supports, in a groove provided near a rear end in the A (−) direction (the second direction), the blade base shaft portion 27*b* extending at a right angle to the A direction (the main scanning direction). The cleaning unit base 24 has the grooves 24*a* extending in the A direction as a whole and having a vertical step partially. The arms 23*b* are supported in the grooves 24*a* at a right angle to the A direction.

The blade base 27 is provided with a stopper shaft portion 27*c* on which a blade base stopper 28 is pivotally supported in such a manner as to be able to turn. The blade base stopper 28 holds the blade 26 at a wipable position. A tension spring 29 is suspended between the blade base stopper 28 and the cleaning unit base 24. The blade base stopper 28 elevates along with the blade 26 against the tensile force generated by the tension spring 29. The blade base stopper 28 is configured to descend along with the blade 26 yielding to the tensile force by the tension spring 29.

The cleaning unit base 24 has, on the upper surface of a portion thereof, a placement surface 24*b* where the blade base stopper 28 is placed at a retreat position. The blade base stopper 28 has, on a radial portion thereof, a placement part 28*b* including a downwardly-protruding surface. The placement part 28*b* is configured to engage with the placement surface 24*b*.

Figure 8:
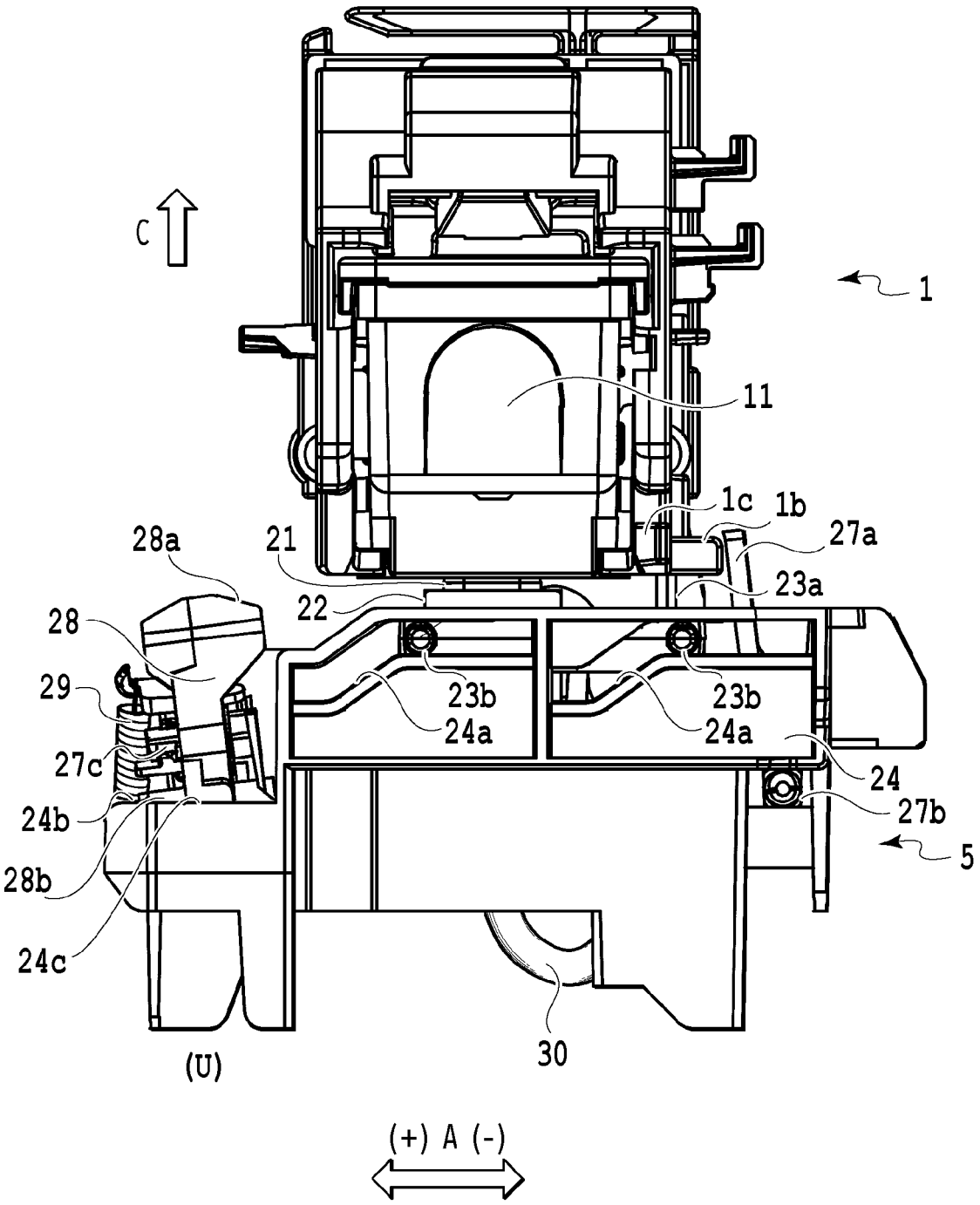
FIG. 8 is a side view showing a state where the blade is located at the retreat position.

As shown in FIGS. 7 and 8, while the blade 26 is at the retreat position U where no wiping is performed, the blade base stopper 28 is biased toward the cleaning unit base 24 by the tension spring 29. The placement part 28*b* is thus placed and held on the placement surface 24*b*.

The blade base stopper 28 has an engagement portion 28*a* including slanted surfaces slanting relative to an A (+) direction (a first direction) and the A (−) direction (the second direction). The carriage unit 1 has a carriage engagement portion 1*c* that engages with the engagement portion 28*a*. The axis of the stopper shaft portion 27*c* is at a right angle to the axis of the blade base shaft portion 27*b*. The blade base stopper 28 is configured to turn about the stopper shaft portion 27*c* as the carriage engagement portion 1*c* pushes the engagement portion 28*a* in the A (+) direction, and then release the blade base 27 being held.

The cleaning unit base 24 has, on the upper surface of a portion thereof, a holding surface 24*c* which is upwardly-facing and horizontal and holds the blade base stopper 28 at the wipe position. The blade base stopper 28 has, at one end in its radial direction, a holding portion 28*c* having a downwardly-protruding surface. The holding portion 28*c* is configured to engage with the holding surface 24*c*.

Figure 9:
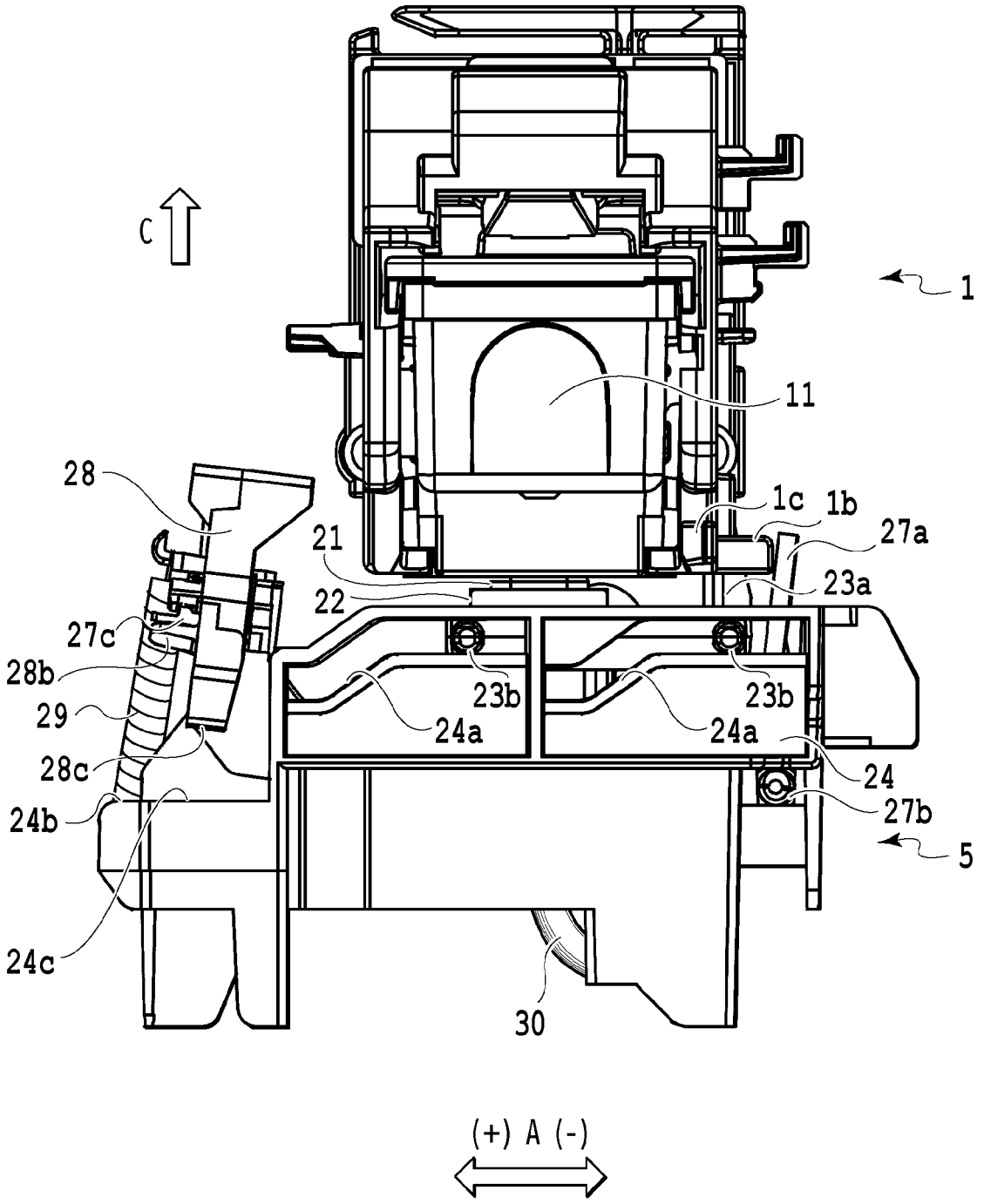
FIG. 9 is a side view showing a state where the blade is being moved from the retreat position to the wipe position.
Figure 10:
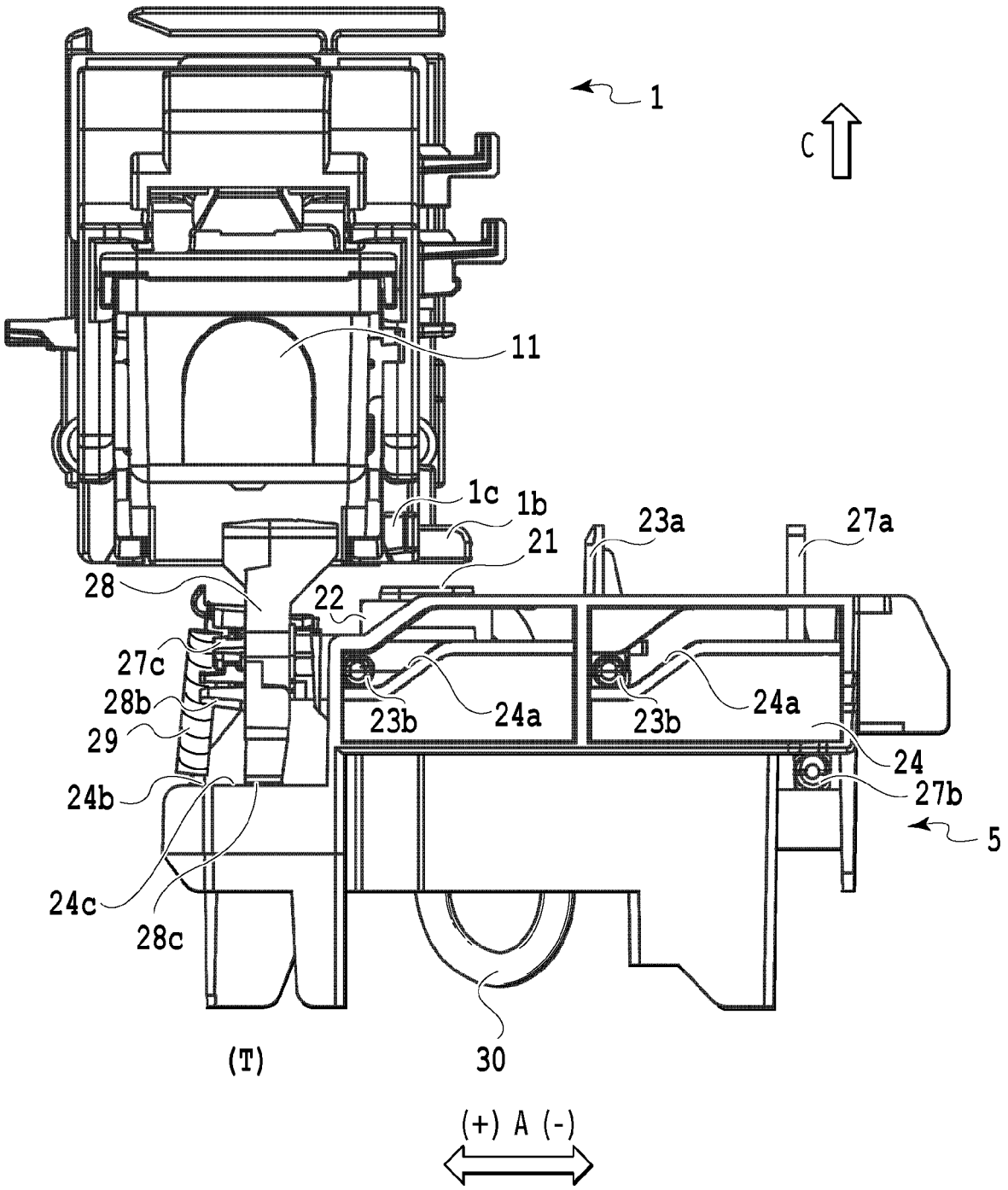
FIG. 10 is a side view showing a state where the blade is located at the wipe position.

To hold the blade 26 at the wipe position T where wiping is performed as shown in FIG. 10, the blade 26 elevates as the blade base 27 turns (FIG. 9), and the blade 26 descends as the carriage unit 1 moves in the A (+) direction (the first direction) (FIG. 10). In this event, the blade base stopper 28 is biased toward the cleaning unit base 24 by the tension spring 29, and the holding portion 28*c* is held on the holding surface 24*c*.

The mechanism for moving the blade 26 of the present embodiment is not limited to the example shown, and for example, a mechanism using a solenoid element or any other mechanism may be employed instead.

Figure 12:
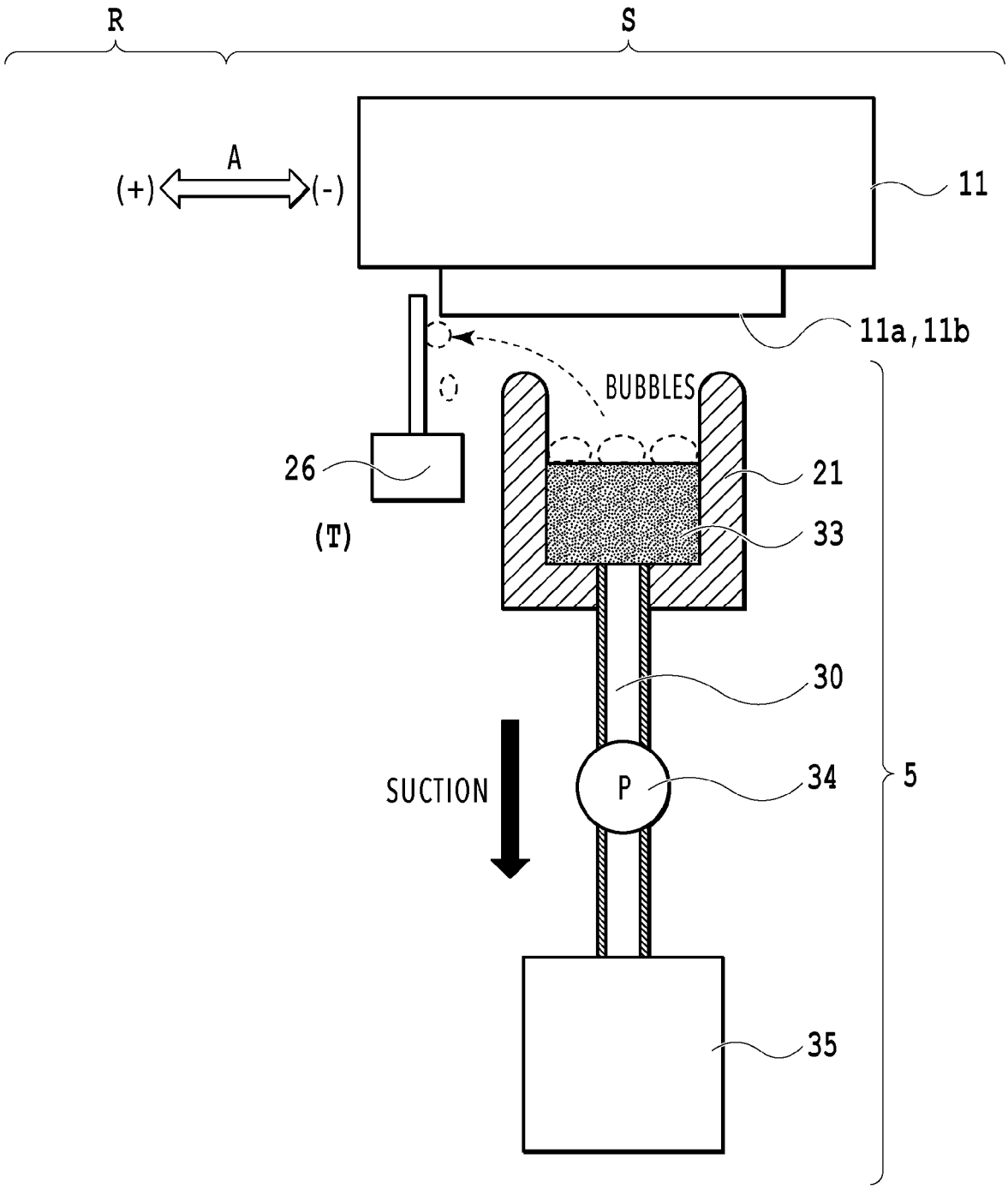
FIG. 12 is a diagram illustrating how scattering of ink is reduced.

The "wipe position" in the present embodiment refers to the position of the blade 26 where wiping can be performed, but typically refers to the position of the blade 26 where wiping can be performed as the ejection ports 11*a* of the recording head move toward the blade 26. In this event, as shown in FIG. 12, the upper edge of the blade 26 is located at a higher level than the ejection port surface 11*b*. Moving the recording head 11 toward the blade 26 with the upper edge of the blade 26 being located at a higher level than the ejection port surface 11*b* allows the ejection ports 11*a* to be wiped with the blade 26.

The "retreat position" in the present embodiment refers to the position of the blade where wiping is not performed. However, the "retreat position" typically refers to the position where no wiping using the blade 26 is performed because moving the ejection ports 11*a* of the recording head toward the blade does not bring the blade and the ejection ports 11*a* into contact with each other. In a state where the blade 26 has been moved to the retreat position U, it is necessary to ensure that moving of the recording head 11 does not bring the blade 26 and the ejection ports 11*a* into contact with each other. To this end, the upper edge of the blade 26 in the retreat position U is at a lower level than the upper surface of the cap 21.

Capping and Wiping Operation

Next, capping and a wiping operation are described using FIGS. 7 to 10. To clean the recording head 11, first, the carriage unit 1 in which the recording head 11 is mounted moves toward the cleaning unit 5 in the A (−) direction (the second direction). Then, a first abutment portion (not shown) of the carriage unit 1 engages with the first lever 23*a* provided to the cap base 23 (FIG. 7).

At this point, the cap 21 is positioned horizontally (the directions indicated by arrows A and B in FIG. 1) relative to the ejection port surface 11*b* where the ejection ports 11*a* are provided. To perform preparatory ejection before, for example, printing an image, ink droplets are ejected into the cap 21 in this state. To cap the ejection ports 11*a*, the carriage unit 1 moves further in the A (−) direction. The cap 21 is thus moved together with the cap base 23, pushing the first lever 23*a* in and following the movement of the carriage unit 1.

Since the arms 23*b* of the cap base 23 move along the grooves 24*a* in the cleaning unit base, the cap 21 moves not only in the movement direction of the carriage unit 1, but also in the direction of arrow C. Then, the cap 21 is biased toward the ejection ports 11*a*.

The cap 21 is biased together with the cap holder 22 toward the cap base 23 in the direction of arrow C (in the direction toward the recording head 11) by a spring (not shown). Thus, after coming into contact with the ejection ports 11*a*, the cap 21 hermetically seals the ejection ports 11*a* by sinking into the cap base 23 together with the cap holder 22 and conforming to the ejection port surface 11*b* of the recording head 11 (the state in FIG. 8).

To perform nozzle suction to suck ink out of the ejection ports 11*a*, the suction pump 34 (FIGS. 11 and 12) that is connected to a tube 30 is driven in this state. By thus depressurizing the inside of the cap 21, a negative pressure is forcibly applied to the insides of the ejection ports 11*a* to perform nozzle suction of ink. The ink thus sucked by the nozzle suction is transferred along the tube 30, passes the suction pump 34, and is discharged to the waste liquid tank 35. In the present embodiment, "nozzle suction" means sucking ink from the ejection ports in a capping state.

To perform wiping, the carriage unit 1 moves further in the A (−) direction (the second direction) from the state in FIG. 8. Then, a second abutment portion 1*b* of the carriage unit 1 pushes the second lever 27*a* provided to the blade base 27. Thus pushed, the second lever 27*a* turns about the blade base shaft portion 27*b* of the blade base 27, elevating the blade 26 (the state in FIG. 9).

As the blade 26 elevates, the blade base stopper 28 pivotally supported by the stopper shaft portion 27*c* turns in the direction of arrow C against the tension spring 29. Then, after the carriage unit 1 moves away from the second lever 27*a* in the A (+) direction (the first direction), the blade base 27 turns in the opposite direction from the direction of arrow C due to the returning force exerted by the tension spring 29. Then, the holding portion 28*c* of the blade base stopper 28 engages with and is held on the holding surface 24*c* of the cleaning unit base 24.

While the carriage unit 1 moves in the A (+) direction with the cleaning unit 5 being in this state, the blade 26 comes into contact with the ejection port surface 11*b* of the recording head 11. While the carriage unit 1 moves away from the cleaning unit 5 in the A (+) direction in that state, the blade 26 wipes the ejection port surface 11*b* (the state in FIG. 10).

To return from the wipe position T shown in FIG. 10 to the retreat position U shown in FIG. 8, the carriage unit 1 moves in the A (+) direction (the first direction). Then, the carriage engagement portion 1*c* of the carriage unit 1 comes into contact with the engagement portion 28*a* of the blade base stopper 28, turning the blade base stopper 28 about the stopper shaft portion 27*c*. When the blade base stopper 28 turns, the engagement with the cleaning unit base 24 is released, and the tension spring 29 causes the blade base 27 to turn, moving the blade 26 back to its original retreat position U.

Preparatory Ejection

Figure 11:
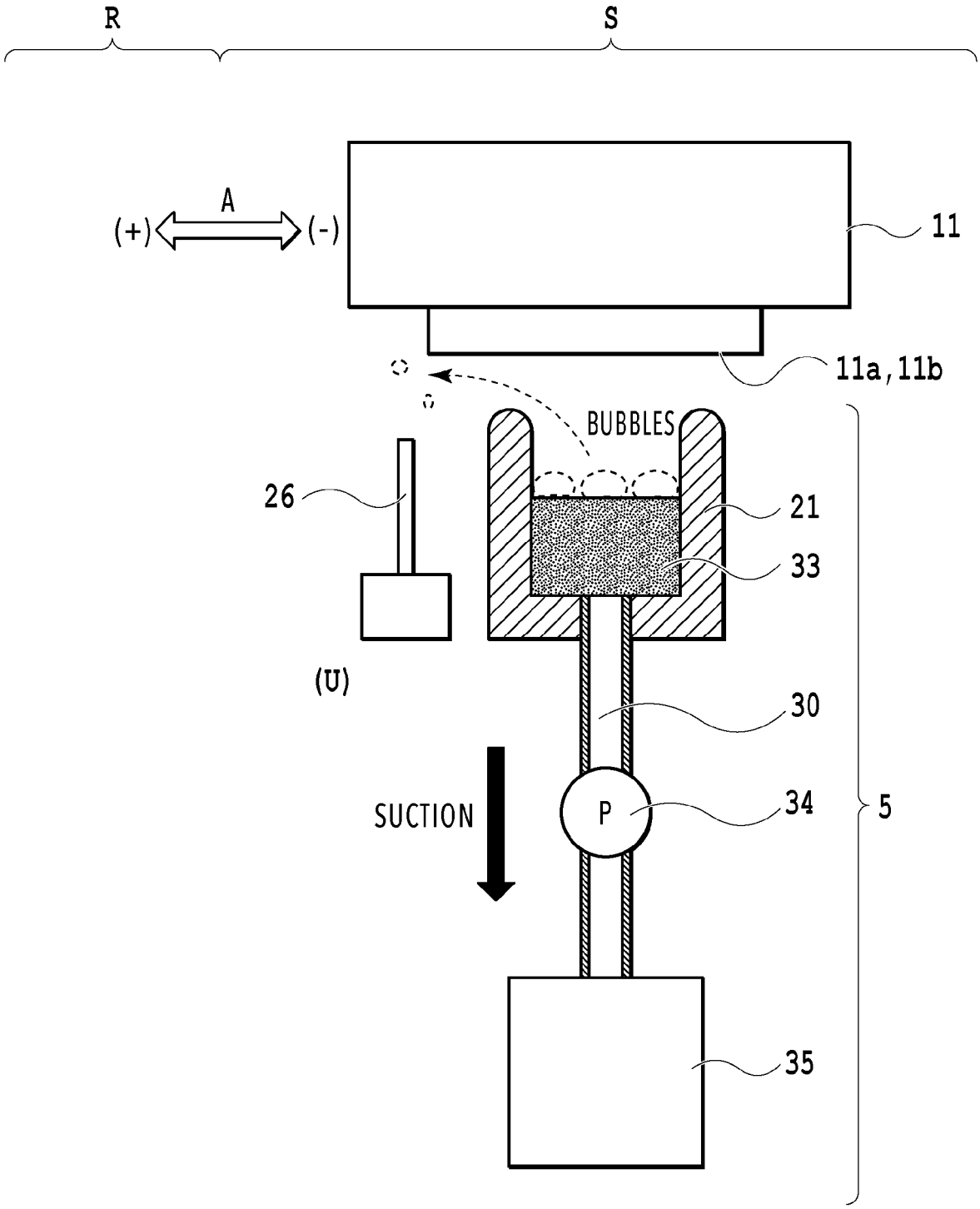
FIG. 11 is a diagram illustrating how ink scatters.

Next, using FIG. 11, a description is given of a cleaning operation during which ink may scatter.

As shown in FIG. 11, an absorber 33 in the cap 21 receives ink discharged from the ejection ports 11*a* by a cleaning operation. In this event, as described earlier, a large amount of ink may be discharged depending on the state of the ejection ports 11*a*. Then, the liquid level of the ink in the absorber 33 rises due to the ink discharged thereto, and air present in the absorber 33 may be pushed out to the surface of the absorber 33 to generate bubbles.

Particularly in a case where an image is faultily recorded, the ejection ports 11*a* have to be subjected to powerful cleaning. Preparatory ejection performed during powerful cleaning discharges more ink than preparatory ejection performed for other purposes. The more shots the preparatory ejection makes, the more ink the absorber 33 absorbs and the larger the volume of air pushed out from the absorber. Hence, bubbles are more likely to be generated on the surface of the absorber 33.

For example, in a configuration as the inkjet recording apparatus 100 in which the cleaning unit 5 in the non-recording region and the recording region are close to each other, when ink droplets scatter around the cap 21, the ink droplets may adhere to and contaminate a recording medium to be recorded on or the recording surface reference member 4.

For this reason, in the configuration of the inkjet recording apparatus 100 of the present embodiment, preparatory ejection from the ejection ports 11*a* to the cap 21 is performed for the purpose of cleaning the recording head 11 by using the blade 26 being located at the wipe position T. Consequently, even in a case where ink scatters due to the breakage of bubbles generated on the surface of the absorber 33, the ink is received by the blade 26 and therefore does not adhere to the recording region. Then, the ink received by the blade 26 flows out to and is deposited in an ink receiver (not shown) provided below the blade 26. Scattering of ink during preparatory ejection can be reduced by the above operation.

In this case, the blade 26 at the wipe position T functions as a shield member capable of shielding the recording region R from ink scattering from the non-recording region S. In the present embodiment, "preparatory ejection" is to eject ink from the ejection ports to the cap that is not in the capping state. Also, "the number of shots of preparatory ejection" in the present embodiment is the total number of times ink is ejected or of times the ink ejecting operation is performed in the step of preparatory ejection.

As shown in FIG. 12, the cleaning unit 5 including the cap 21 is placed in the non-recording region S. In the moving direction of the recording head 11, the blade 26 is located between the recording region R and the cap 21. Thus, to wipe the recording head 11 that is in a capping state, the recording head 11 is brought out of the state of being capped by the cap 21 and is moved toward the recording region R with the blade 26 being at the wipe position T. Thus, the wiping operation can be performed smoothly.

In order to perform the wiping, the recording head 11 needs to be moved so that the ejection port surface 11*b* may move beyond the blade 26 in the A (+) direction. This is for performing the wiping by moving the carriage unit 1 so that the ejection port surface 11*b* may pass the blade 26 with the blade 26 being in contact with the ejection port surface 11*b*.

Thus, in a case where the blade 26 is provided on the opposite side of the cap 21 from the position of the blade 26 in FIG. 12, the moving range of the carriage unit 1 is extended in the A (−) direction, leading to an increase in the size of the apparatus. Such an increase in the size of the apparatus can be avoided by providing the blade 26 between the recording region R and the cap 21, as shown in FIG. 12.

By being positioned at the wipe position T, the blade 26 shields the non-recording region S where the cleaning unit 5 for cleaning is provided and the adjacent recording region R from each other, helping prevent ink scattered from the cap 21 in the non-recording region S from reaching the recording region R. By being elevated upward as seen in the drawings (the direction along the C axis in FIG. 4), the blade 26 adjacent to the cap 21 can receive, with its upper portion, ink scattered during preparatory ejection, as shown particularly in FIG. 12.

Scattered ink may be received not only by the blade 26 but also by the ejection port surface 11*b*. Although the ejection ports 11*a* are provided on the ejection port surface 11*b*, the areas of the ejection ports 11*a* are very small compared to the area of the ejection port surface 11*b*. Thus, adhesion of scattered ink to the ejection port surface 11*b* is unlikely to affect the ejection performance, and therefore scattered ink may be received by the ejection port surface 11*b*. As shown in FIGS. 11 and 12, in the moving direction of the recording head, the width of the ejection port surface 11*b* is larger than the width between the inner surfaces of the cap 21. Thus, even in a case where bubbles in the cap 21 scatter upward, the ejection port surface 11*b* can easily receive them.

To reduce scattering of ink to the recording region R, the position to which the blade 26 is elevated upward in the drawings (the direction along the C axis in FIG. 4) may be set so that the upper edge of the blade 26 may be at the same level as or higher than the ejection port surface 11*b*. Then, no space is created vertically between the upper edge of the blade 26 and the ejection port surface 11*b*.

By performing preparatory ejection with no space being created vertically between the blade 26 and the ejection port surface 11*b*, ink scattering during preparatory ejection can be received by the blade 26 and the ejection port surface 11*b*. In other words, scattering of ink to the recording region R can be reduced.

In the present embodiment, the upper edge of the blade 26 in the wipe position T is located higher than the ejection port surface 11*b*, and the upper edge of the blade 26 in the retreat position U is located lower than the ejection port surface 11*b*.

The width of the blade 26, or the length of the blade 26 in the sub scanning direction B, is preferably the same as or more preferably longer than the length of the upper surface of the absorber 33 in the cap 21 in the sub scanning direction B. In this way, it is possible to isolate a region where cleaning is performed from a region where ink should not scatter.

EXAMPLES

Figure 13:
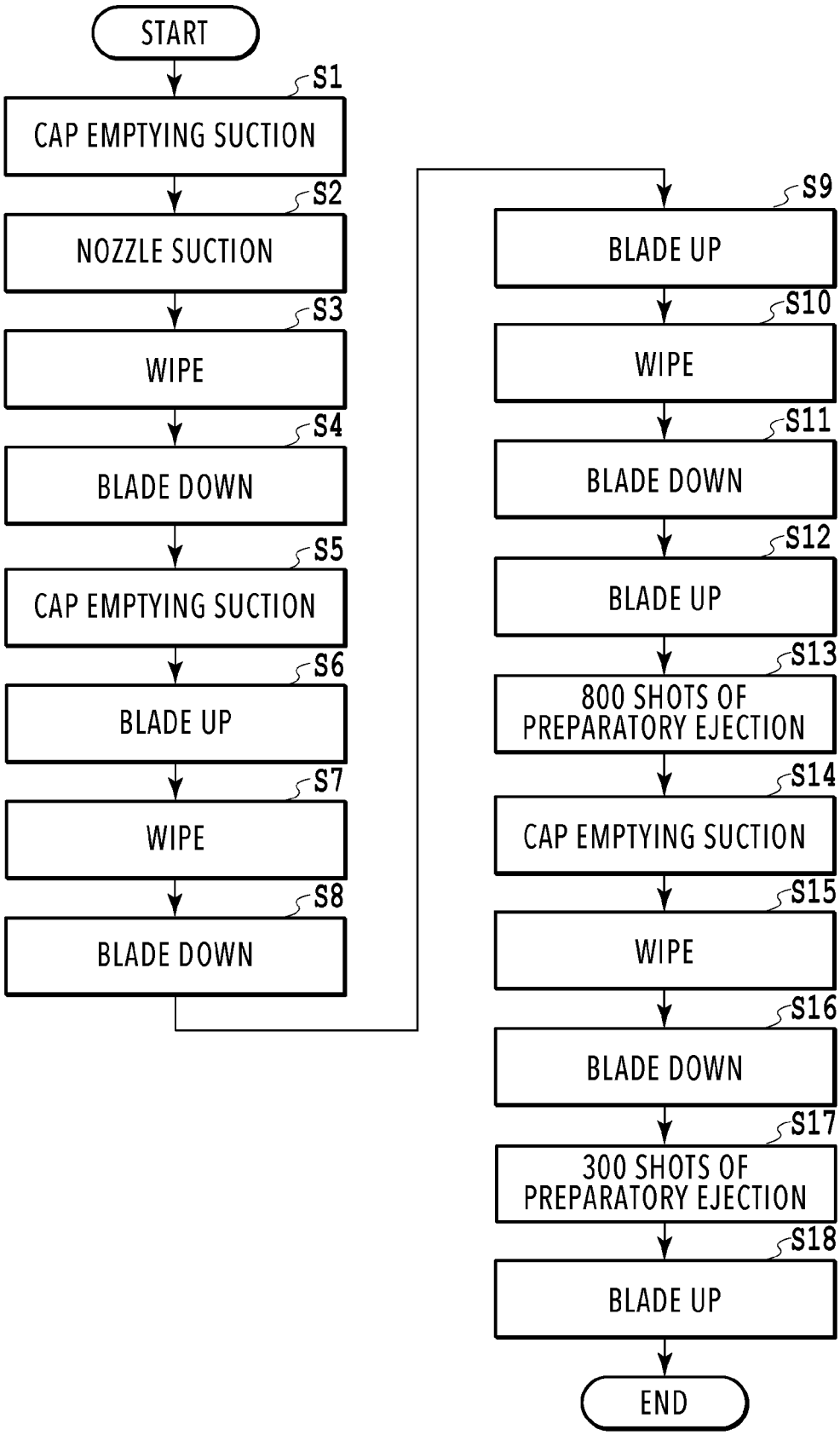
FIG. 13 is a flowchart illustrating control performed for cleaning which is carried out manually by a user in a case where an image is faultily recorded during printing.
Figure 14:
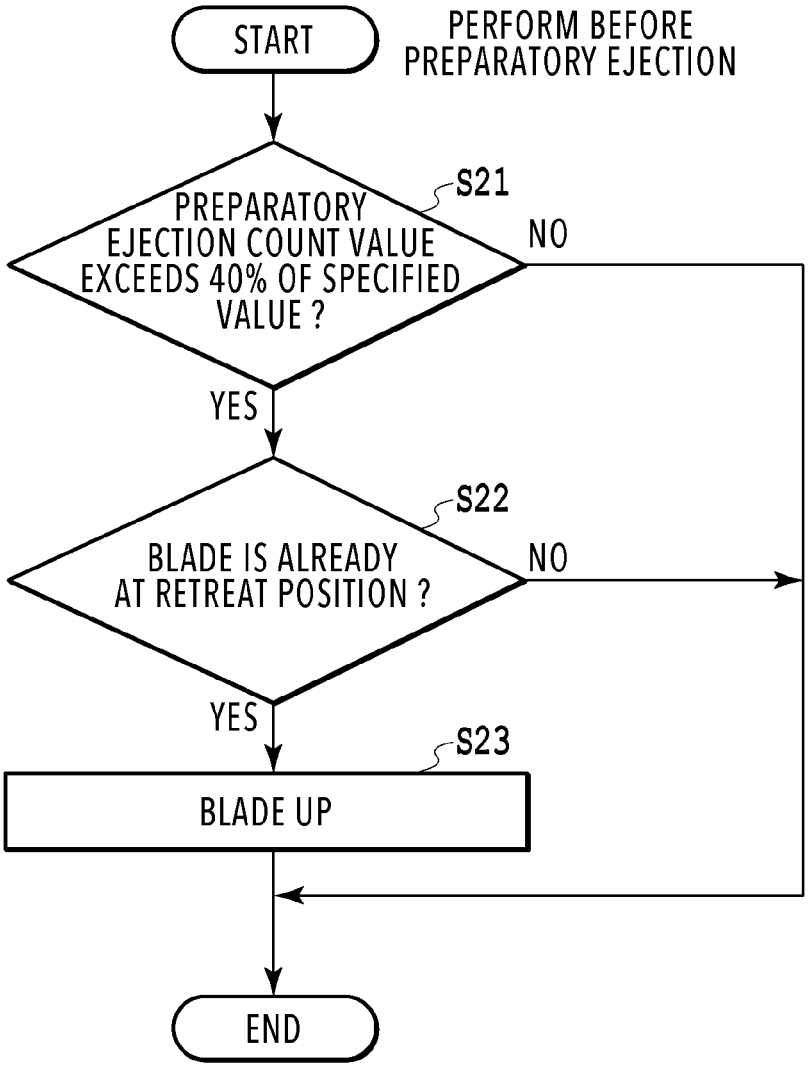
FIG. 14 is a flowchart illustrating control performed to determine whether to elevate the blade.

Using FIGS. 13 and 14, the following describes a control operation for reducing scattering of ink during a preparatory ejection operation of the recording head, which is the characteristics of the examples herein.

Example 1

FIG. 13 is a flowchart illustrating control performed to clean the recording head 11 which is carried out manually by a user upon faulty recording of an image during printing by the inkjet recording apparatus 100. Alternatively, it is a flowchart illustrating control performed to clean the recording head 11 which is carried out automatically in a case where no ejection has been made by the recording head 11 for a certain period of time or longer. In the present example, moving the blade 26 from the retreat position U to the wipe position T is referred to as blade-up, and moving the blade 26 from the wipe position T to the retreat position U is referred to as blade-down.

The sequence of the present example is started with the cap 21 capping the ejection ports 11*a* of the recording head 11 and the blade 26 being located at the wipe position T (see FIG. 12).

In S1, the CPU 302 brings the cap 21 that is in a capping state as to the recording head 11 into a non-capping state, and drives the suction pump 34 to perform cap emptying suction. In this step, the blade 26 is located at the wipe position T.

In S2, the CPU 302 brings the cap 21 that is in a non-capping state as to the recording head 11 into a capping state, and drives the suction pump 34 to perform nozzle suction. The purpose of this nozzle suction is to remove foreign matters and thickened ink inside or on the surface of the ejection ports 11*a*. In this step, the blade 26 is located at the wipe position T.

In S3, the CPU 302 moves the recording head 11 relative to the blade 26, and performs the wiping operation described earlier (FIG. 10). In this step, the blade 26 is located at the wipe position T.

Then, in S4, the CPU 302 moves the carriage unit 1 in the A (+) direction to bring the blade 26 down (blade-down), or in other words, move the blade 26 from the wipe position T to the retreat position U.

In S5, like in S1, the CPU 302 drives the suction pump 34 and performs cap emptying suction to discharge ink remaining in the absorber 33 in the cap 21 and empty the cap 21. In this step, the blade 26 is at the retreat position U.

In S6, to clean residues on the ejection port surface 11*b*, the CPU 302 elevates the blade 26 from the retreat position U to the wipe position T as shown in FIG. 9 above (blade-up).

In S7, the CPU 302 performs the wiping operation described earlier. Then in S8, the CPU 302 moves the blade 26 from the wipe position T to the retreat position U (blade-down). Then in S9, the CPU 302 moves the blade 26 from the retreat position U to the wipe position T (blade-up). Then in S10, the CPU 302 performs the wiping operation again.

The reason for performing the blade-down (S8) and the blade-up (S9) before the wiping operation in S10 is to move the carriage unit 1 in the same direction for the wiping. More specifically, after the blade 26 is placed at the retreat position U in S8, the carriage unit 1 is moved in the A (−) direction. Then, after the blade 26 is placed at the wipe position T in S9, the carriage unit 1 is moved in the A (+) direction in S10. By performing such control, wiping is performed while the carriage unit 1 moves in the A (+) direction.

In the configuration of the present example, performing wiping as the carriage unit 1 moves in the A (−) direction may cause scattering of ink on the blade 26 toward the recording region R once the blade 26 in contact with the ejection port surface 11*b* and then bowing restores after the carriage unit 1 passes.

In a case where wiping is performed as the carriage unit 1 moves in the A (−) direction, the blade 26 in contact with the ejection port surface 11*b* bows and leans toward the A (−) side, and ink wiped off from the ejection port surface 11*b* adheres to the blade 26.

Once the ejection port surface 11*b* passes above the blade 26 to bring the blade 26 out of contact with the ejection port surface 11*b*, the blade 26 restores from its bowing state, and the upper edge of the blade 26 moves toward the A (+) side in reaction. The upper edge of the blade 26 has ink wiped off from the ejection port surface 11*b* as a result of the wiping. Thus, the ink adhering to the upper edge of the blade 26 scatters toward the A (+) side, i.e., toward the recording region R, due to the reaction of the blade 26 after the wiping.

To avoid such adhesion of ink to the recording region R, while the carriage unit is moved in the A (−) direction, i.e., from the recording region R to the non-recording region S, the blade 26 is placed at the retreat position U not to perform the wiping.

By contrast, when the wiping is performed during moving the carriage unit 1 in the A (+) direction, ink scattered by the reaction of the blade 26 after the wiping is scattered toward the non-recording region S, and therefore, there is no risk of the ink adhering to the recording region R.

As described above, by moving the carriage unit 1 in the A (+) direction for the wiping, scattering of ink toward the recording region R can be avoided.

Next, the CPU 302 performs preparatory ejection to condition the meniscus, which is the gas-liquid interface, of the ink in the ejection ports 11*a*. This first preparatory ejection performed after the nozzle suction makes more shots than the preparatory ejection performed for other purposes (e.g., the preparatory ejection performed before starting recording). For this reason, the cap 21 is filled with a large amount of ink, and the volume of air pushed out from the absorber 33 is also large. It is therefore likely that bubbles are generated on the surface of the absorber 33. In other words, the first preparatory ejection after noise suction is likely to generate bubbles of ink and cause scattering of the ink.

In this regard, in S12, the CPU 302 brings the blade up before the first preparatory ejection after nozzle suction, as shown in FIG. 9 referred to above. Specifically, the CPU 302 elevates the blade 26 located at the retreat position U to the wipe position T.

Then in S13, the CPU 302 performs preparatory ejection. In this step, the blade 26 is located at the wipe position T.

In S14, the CPU 302 drives the suction pump 34 and sucks the ink discharged to the cap 21 by the preparatory ejection (cap emptying suction) to empty the cap 21. Then in S15, the CPU 302 performs the wiping operation using the blade 26. In this step, the blade 26 is located at the wipe position T.

Then in S16, the CPU 302 moves the carriage unit 1 in the A (+) direction, and moves the blade 26 from the wipe position T to the retreat position U (blade-down).

Then in S17, the CPU 302 performs preparatory ejection to condition the meniscus in each ejection port 11*a*. In this step, the blade 26 is located at the retreat position U.

In S18, the CPU 302 moves the recording head 11 as shown in FIG. 9, caps the ejection ports 11*a* with the cap 21, and elevates the blade 26 from the retreat position U to the wipe position T (blade-up). The cleaning operation is thus ended.

In the flowchart of Example 1, the CPU 302 performs preparatory ejection with the blade 26 being located at the wipe position T. Even in a case where ink scatters, placing the blade 26 at the wipe position T can help prevent the ink from adhering to the recording region R.

The preparatory ejection (S13) after nozzle suction makes a large number of shots because it is necessary to discharge, for example, air bubbles included into the ejection ports 11*a* by the nozzle suction. By contrast, the other preparatory ejection (S17) may only have a small number of shots because the purpose of this preparatory ejection is to condition the meniscus formed by the ink in the ejection port 11*a*. Fewer shots of preparatory ejection mean less amount of air pushed out from the absorber 33 in the cap 21, and therefore, generation of bubbles and scattering of ink are less likely to occur. Even in a case where bubbles are generated, there is only a small quantity of them, and it is very unlikely that the ink scatters to the recording region R. For this reason, the blade 26 is located at the retreat position U during the preparatory ejection (S17).

However, to further lower the possibility of ink scattering to the recording region R, the blade 26 may be located at the wipe position T even during preparatory ejection that makes a small number of shots.

For the cleaning operation described above, the CPU 302 elevates the blade 26 to the wipe position T at least by the time the first preparatory ejection after nozzle suction of the ejection ports 11*a* is performed. Then, the CPU 302 may keep the blade 26 at the wipe position T until the ink suction (cap emptying suction) operation performed after the preparatory ejection ends. This helps prevent scattering of ink generated during the cleaning operation.

To perform cleaning more powerful than the cleaning described above (also referred to as powerful cleaning and weak cleaning, respectively), the number of shots of preparatory ejection may be increased (e.g., 6000 shots of preparatory ejection), and further, steps of nozzle suction and cap-emptying suction may be added to the cleaning described above.

In the ways described above, in Example 1, scattering of ink to the recording region R can be reduced. Scattering of ink which may occur during the preparatory ejection operation of the recording head 11 can be reduced. Since there is no need to provide any dedicated shield means or suction fan inside the apparatus to reduce the ink scattering, the unit can have a compact size, and costs can be reduced. Further, the distance between the cleaning unit 5 and the recording region R can be shortened, which allows reduction in the size of the apparatus.

Before preparatory ejection is performed after nozzle suction, the blade 26 needs to be moved from the retreat position U to the wipe position T. In Example 1, the blade 26 has already been moved to the wipe position T before the preparatory ejection, and thus the preparatory ejection step can be performed speedily. Then, the cleaning operation step can be performed speedily. In a case of using electric power such as a solenoid element to hold the blade 26 at the wipe position T, the blade may be moved to the wipe position T using electric power only in a case where preparatory ejection is necessary. Power can be saved consequently, and the life of the solenoid component can be extended.

Further, in Example 1, during the series of operations in the cleaning operation, it is preferable that the blade 26 is located at the retreat position U while neither the preparatory ejection nor the wiping operation is performed. During the cleaning operation, ink may adhere to the upper edge or elsewhere of the blade 26. Placing the blade 26 at the retreat position U can prevent the ink adhering to the blade 26 from re-adhering to the carriage unit 1 moving for the cleaning operation.

In Example 1, the blade 26 is located at the wipe position T during preparatory ejection. However, the position of the blade 26 is not limited to this. As long as the upper edge of the blade 26 is at the same level as or at a higher level than the ejection port surface 11*b* during preparatory ejection, scattering of ink from the cap 21 to the recording region R during the preparatory ejection can be reduced.

Example 2

Example 2 is a control method in which the number of shots of preparatory ejection to the inside of the cap 21 is counted in advance, and it is determined based on the count value whether to elevate the blade 26.

Since the basic configuration of Example 2 is the same as that described in Example 1, a description is given using FIG. 14 only about a method for determining whether to elevate the blade based on the count value (the number of shots of preparatory ejection) which is the characteristic of this example.

FIG. 14 is a flowchart illustrating control performed to determine whether to elevate the blade.

First in S21, when performing preparatory ejection from the ejection ports 11*a* to the cap 21, the CPU 302 determines whether the amount of ink discharged by the preparatory ejection exceeds a predetermined percentage of the amount of ink that the cap 21 can receive. For example, in a case where the amount of ink that the cap 21 can receive corresponds to 1,000,000 dots calculated in terms of the number of shots of preparatory ejection, the CPU 302 determines whether the amount of ink of preparatory ejection exceeds 400,000 shots, which is 40% of the amount of ink that the cap 21 can receive.

By determining whether the preparatory ejection count value (the number of shots of preparatory ejection) exceeds 40% of a specified value, the CPU 302 determines the amount of ink described above.

The preparatory ejection count value can be reset to zero at the first cap emptying suction, which is performed immediately after the preparatory ejection.

[A Case where the Count Value does not Exceed 40%]

In a case where the preparatory ejection count value does not exceed 40% of a predetermined amount of the ink that can be received in the cap 21, i.e., in a case where the number of shots of preparatory ejection obtained by counting the number of times ink is ejected does not exceed 400,000 shots, the CPU 302 does not elevate the blade 26 and ends the determination about elevation.

[A Case where the Count Value Exceeds 40%]

In a case where the preparatory ejection count value exceeds 40% of a predetermined amount of the ink that can be received in the cap 21, i.e., in a case value the number of shots of preparatory ejection obtained by counting the number of times ink is ejected exceeds 400,000 shots, in S22 the CPU 302 determines where the blade 26 is being located. In a case where the blade 26 is at the retreat position U, in S23 the CPU 302 elevates the blade 26 to the state shown in FIGS. 6 and 10. By the above determination, by the time the immediately following preparatory ejection is performed, the blade 26 has been elevated to the wipe position T, and therefore scattering of ink during the preparatory ejection can be reduced.

Also in a case where it is determined in S22 that the blade 26 is already up at the wipe position T, scattering of ink during the immediately following preparatory ejection can be reduced.

In Example 2, preparatory ejection is performed with the blade 26 being elevated in a case where the amount of ink determined by a determining unit exceeds a predetermined amount, and therefore, the operation of elevating or descending the blade for the preparatory ejection can be performed at desired timing as needed, which allows achieving extension of the component life and simplification of the cleaning operation.

In Example 2, the determining unit is configured as a counting means that counts the number of times ink is ejected for preparatory ejection, and makes a determination regarding the number of times ink is ejected as the amount of ink. In this case, there is no need to provide a special sensor or the like for detecting the amount of ink, which allows the determinations to be made at low costs. Further, the determination method can be flexibly changed according to the ejection method that the recording head uses and the structure of the cap.

The blade elevation determination is preferably made immediately before preparatory ejection is performed during the cleaning operation in the inkjet recording apparatus 100.

While both of Examples 1 and 2 can offer the ink scattering reduction effect similarly, Example 2 changes the operation of elevating the blade 26 as needed, and therefore extends the life of a component such as, for example, a solenoid component and simplifies the cleaning operation. For these reasons, the configuration of Example 2 may be better.

Reference Example

Figure 15:
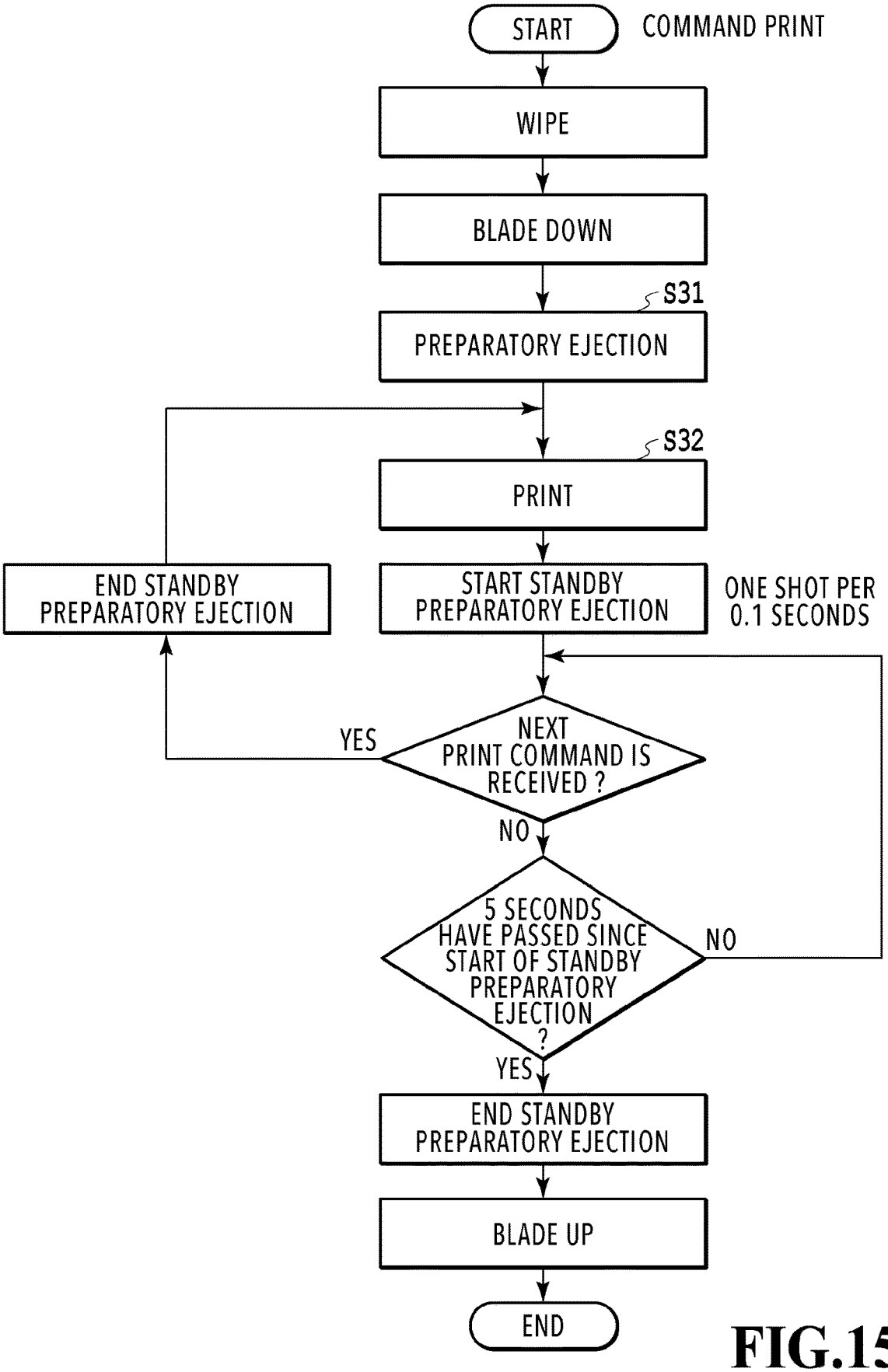
FIG. 15 is a flowchart of a reference example illustrating a cleaning operation in which preparatory ejection is performed which is different from that performed in the cleaning operation of the present invention.

Next, using FIG. 15, an example of performing preparatory ejection for the purpose of other than the cleaning operation is described as a reference example.

FIG. 15 is a flowchart illustrating control of cleaning performed not for the cleaning operation, but for printing. The CPU 302 performs preparatory ejection from the ejection ports 11*a* in S31 before printing in order to discharge ink thickened during standby before printing. In this event, the CPU 302 determines whether to elevate the blade 26 as described above using FIG. 14.

Then in S32, printing is performed. Since it is determined in S31 whether to elevate the blade 26 according to the number of shots of the immediately preceding preparatory ejection, the printing operation can be performed without being affected by scattering of ink.

Although 40% of the amount of ink that can be received in the cap is set as a threshold or a predetermined amount in the examples herein, a numerical value calculated in terms of the volume of ink in the cap or the number of shots of preparatory ejection may be set as a threshold or a specified value and used for the determination. The examples herein also include a configuration in which a sensor is additionally provided to detect the volume of ink in the cap instead of counting the shots of preparatory ejection.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-030989 filed Feb. 26, 2020, which is hereby incorporated by reference wherein in its entirety.

What is claimed is:

1. An inkjet recording apparatus that performs inkjet recording on a recording medium in a recording region, comprising:

a recording head that includes an ejection port surface where an ejection port for ejecting ink is provided, the recording head being movable within a range including the recording region and a non-recording region where the recording is not performed;

a carriage that supports the recording head;

a carriage moving unit that moves the carriage;

a cap capable of setting the ejection port in a capping state in the non-recording region;

a blade that is placed between the recording region and the cap in a moving direction of the recording head, the blade being capable of wiping the ejection port of the recording head in a case where the recording head moves from the non-recording region to the recording region;

a blade moving unit capable of moving the blade up and down, the blade moving unit being capable of moving the blade to a first position where an upper edge of the blade is at a higher level than the ejection port surface and to a second position where the upper edge of the blade is at a lower level than the ejection port surface; and a control unit configured to control the recording head, the carriage moving unit, and the blade moving unit, wherein in a case that the control unit causes the carriage moving unit to move the recording head from the recording region to the non-recording region, the control unit causes the blade moving unit to place the blade at the second position in a state where the ejection port surface and the blade are at positions overlapping with each other in the moving direction, and wherein the control unit causes the blade moving unit to place the blade at the first position in an event where the control unit causes the recording head to perform preparatory ejection, the preparatory ejection being to eject ink from the ejection port to the cap that is not in the capping state.

2. The inkjet recording apparatus according to claim 1, wherein the second position is where the upper edge of the blade is at a lower level than an upper surface of the cap.

3. The inkjet recording apparatus according to claim 1, wherein the first position is where the blade is located while the wiping is performed.

4. The inkjet recording apparatus according to claim 1, wherein the blade moving unit moves the blade to the first position and moves the blade to the second position based on the movement of the carriage.

5. The inkjet recording apparatus according to claim 1, further comprising a suction pump that applies a negative pressure to an inside of the cap to suck, wherein the control unit causes the suction pump to perform nozzle suction to suck the ink from the ejection port by applying a negative pressure to the inside of the cap in the capping state, and wherein the control unit causes the blade moving unit to place the blade at the first position after the nozzle suction and before the preparatory ejection.

6. The inkjet recording apparatus according to claim 1, further comprising a determining unit that determines an amount of the ink in the cap, wherein in a case where it is determined that the preparatory ejection causes the amount of ink inside the cap to exceed a predetermined amount, the preparatory ejection is performed with the blade being located at the first position.

7. The inkjet recording apparatus according to claim 6, wherein the determining unit determines the amount of ink in the cap based on a number of shots of the preparatory ejection.

8. An inkjet recording apparatus that performs inkjet recording on a recording medium in a recording region, comprising:

a recording head that includes an ejection port surface where an ejection port for ejecting ink is provided, the recording head being movable within a range including the recording region and a non-recording region where the recording is not performed;

a carriage that supports the recording head;

a carriage moving unit that moves the carriage;

a cap capable of setting the ejection port in a capping state in the non-recording region;

a blade that is placed between the recording region and the cap in a moving direction of the recording head, the blade being capable of wiping the ejection port of the recording head in a case where the recording head moves from the non-recording region to the recording region;

a blade moving unit capable of moving the blade up and down, the blade moving unit being capable of moving the blade to a first position where an upper edge of the blade is at a same level as the ejection port surface and to a second position where the upper edge of the blade is at a lower level than the ejection port surface; and a control unit configured to control the recording head, the carriage moving unit, and the blade moving unit, wherein in a case that the control unit causes the carriage moving unit to move the recording head from the recording region to the non-recording region, the control unit causes the blade moving unit to place the blade at the second position in a state where the ejection port surface and the blade are at positions overlapping with each other in the moving direction, and wherein the control unit causes the blade moving unit to place the blade at the first position in an event where the control unit causes the recording head to perform preparatory ejection, the preparatory ejection being to eject ink from the ejection port to the cap that is not in the capping state.

* * * * *